US009676218B2

(12) United States Patent
Kuhne et al.

(10) Patent No.: US 9,676,218 B2
(45) Date of Patent: Jun. 13, 2017

(54) HEAT SENSITIVE RECORDING MATERIAL

(71) Applicant: PAPIERFABRIK AUGUST KOEHLER SE, Oberkirch (DE)

(72) Inventors: Lutz Kuhne, Ohlsbach (DE); Uwe Brasch, Offenburg (DE)

(73) Assignee: PAPIERFABRIK AUGUST KOEHLER SE, Oberkirch (DE)

( * ) Notice: Subject to any disclaimer, the term of this patent is extended or adjusted under 35 U.S.C. 154(b) by 0 days.

(21) Appl. No.: 14/766,540

(22) PCT Filed: Feb. 7, 2014

(86) PCT No.: PCT/DE2014/100043
§ 371 (c)(1),
(2) Date: Aug. 7, 2015

(87) PCT Pub. No.: WO2014/121788
PCT Pub. Date: Aug. 14, 2014

(65) Prior Publication Data

US 2015/0367664 A1 Dec. 24, 2015

(30) Foreign Application Priority Data

Feb. 8, 2013 (DE) ..... 10 2013 002 297

(51) Int. Cl.
*B41M 5/337* (2006.01)
*B41M 5/42* (2006.01)
*B41M 5/44* (2006.01)

(52) U.S. Cl.
CPC ..... *B41M 5/3372* (2013.01); *B41M 5/42* (2013.01); *B41M 5/44* (2013.01); *B41M 2205/04* (2013.01); *B41M 2205/38* (2013.01)

(58) Field of Classification Search
CPC ..... B41M 5/337; B41M 5/3372; B41M 5/42; B41M 5/44; B41M 2205/04; B41M 2205/38
USPC ..... 503/207, 214, 226
See application file for complete search history.

(56) References Cited

U.S. PATENT DOCUMENTS

| | | | | |
|---|---|---|---|---|
| 6,677,386 | B1 * | 1/2004 | Giezen | C08B 30/12 106/206.1 |
| 6,759,366 | B2 | 7/2004 | Beckerdite et al. | |
| 8,183,175 | B2 * | 5/2012 | Masuda | B41M 5/42 427/152 |
| 8,513,160 | B2 | 8/2013 | Hada et al. | |
| 8,623,785 | B2 | 1/2014 | Takahama et al. | |
| 2007/0219093 | A1 | 9/2007 | Shimbo et al. | |
| 2010/0048394 | A1 | 2/2010 | Horn et al. | |
| 2010/0062195 | A1 | 3/2010 | Masuda | |

FOREIGN PATENT DOCUMENTS

| | | | |
|---|---|---|---|
| DE | 112007002203 | T5 | 7/2009 |
| EP | 2130681 | A2 | 12/2009 |
| GB | 2187297 | A | 9/1987 |
| JP | H0692029 | A | 4/1994 |
| WO | 2008006474 | A1 | 1/2008 |
| WO | 2008022127 | A2 | 2/2008 |
| WO | 2010065750 | A1 | 6/2010 |

OTHER PUBLICATIONS

Bloembergen et al., Journal Techlink dated Sep., 2008, "Paper Binder Performance with Biobased Nanoparticles", pp. 46-48.

* cited by examiner

*Primary Examiner* — Bruce H Hess
(74) *Attorney, Agent, or Firm* — Fay Sharpe LLP

(57) ABSTRACT

The invention relates to a heat-sensitive recording material having a flat support, a thermal reaction layer on at least one face of the flat carrier, and optionally an intermediate layer formed between the flat support and the respective thermal reaction layer, and optionally other layers, a crosslinked biopolymer material in the form of nanoparticles being used as a binder in at least one of the layers. The invention also relates to the production and the use thereof.

20 Claims, No Drawings

HEAT SENSITIVE RECORDING MATERIAL

The invention relates to a heat-sensitive recording material (thermal paper) with a flat support (thermal raw paper), a thermal reaction layer on at least one side of the flat support and optionally an intermediate layer (thermal isolation layer), which is formed between the flat support and the respective thermal reaction layer, as well as selectively with further layers. The invention also relates to a method for producing a heat-sensitive recording material of this type and to its use.

Heat-sensitive recording materials of the type described above are, for example, known from U.S. Pat. No. 6,759,366 and WO 2008/006474 A1.

U.S. Pat. No. 6,759,366 describes a heat-sensitive recording material, which in each case has a thermal reaction layer on the upper and lower side of a support substrate. The support substrate is preferably based on cellulose and is thermally insulating. This ensures that the heat pulse generated during thermal printing is for the largely available for the development of the thermal reaction layer. A so-called primer layer, by means of which better adhesion of the layers and the heat insulation necessary for thermal printing are achieved, is preferably formed between the support substrate and the thermal reaction layer.

WO 2008/006474 A1 also discloses a heat-sensitive recording material with a flat support, a thermal reaction layer on at least one side of the flat support and an intermediate layer, which is formed between the flat support and the respective thermal reaction layer and contains hollow sphere pigments embedded in a binder, and optionally with further layers and/or upper layers, the hollow sphere pigments being present as a composite pigment, and nanoscale pigment particles adhering to the surface of an organic hollow sphere pigment. The recording material known from WO 2008/006474 A1 especially exhibits improved insulating properties. A material containing said pigments in a suitable binder is applied as the intermediate layer. The binder is used, especially, to connect the intermediate layers to the flat support as well as possible and to ensure an optimal attachment of the subsequent layers. Synthetic and/or natural polymers are used as the binders.

DE 11 2007 002 203 T5 describes a thermal recording material, which comprises an intermediate layer and a thermal recording layer, which are laminated on a support in this order, the intermediate layer being a layer, which is obtained by applying a coating liquid, which contains a swellable starch and a pigment in a dispersed state in a dispersing medium consisting of water as the main component, and the intermediate layer contains a heat-insulating organic pigment, which is in the form of hollow or cup-shaped particles.

Binders are generally of great importance in heat-sensitive recording materials. They are used to fix pigments and other components, such as colour formers, co-reactants, sensitizers and slip additives as well as further additives. Binders also promote the connection of the various layers to one another. Starches, polyvinyl alcohol or synthetic binders, such as, for example, styrene/butadiene lattices and styrene/acrylate lattices are generally used as the binders. Binders may be applied in pure form directly to the raw paper on one or both sides as the surface sizing or be introduced by so-called sump operation over the paper surface into the paper (impregnation).

The known heat-sensitive recording materials have various drawbacks, however, for example with respect to the ageing resistance, especially when using synthetic binders. These disadvantageous effects come to the fore especially at elevated temperatures and high ambient humidity. Furthermore, the depositing behaviour of the known heat-sensitive recording materials may be critical, especially when using organic hollow sphere pigments in the thermal insulating coat. Finally, the synthetic binders conventionally used in known heat-sensitive recording materials are expensive and involve ecological drawbacks.

The aim of the present invention is therefore to provide a heat-sensitive recording material, which remedies the drawbacks of the known heat-sensitive recording materials. Especially, heat-sensitive recording materials are to be provided that have improved properties with respect to ageing resistance and depositing behaviour. Finally, it would be desirable to reduce the production costs and use environmentally friendly materials.

According to the invention, this aim is addressed by a heat-sensitive recording material according to claim 1, according to which this is constructed from a flat support and a thermal reaction layer on at least one side of the flat support and optionally an intermediate layer, which is formed between the flat support and the respective thermal reaction layer, and selectively further layers, a cross-linked biopolymer material in the form of nanoparticles being used as the binder in at least one of the layers.

In a preferred embodiment, the cross-linked biopolymer material in the form of nanoparticles has a degree of swelling of less than 2, preferably less than 1. The degree of swelling was determined as described in DE 11 2007 002 203 T5:

The degree of swelling relates to a volume expansion when the cross-linked biopolymer material in the form of nanoparticles swells in water. For this purpose, a sample of a water-free quantity of 2 g is added to 200 ml pure water, dispersed therein and directly thereafter this is heated in a water bath that is boiling well for 30 minutes and cooled to room temperature. The part of the water that was evaporated is added and the sample is dispersed again and 100 ml of the dispersion are placed precisely in a measuring cylinder. The measuring cylinder is allowed to stand for 24 hours at room temperature and a precipitate is measured visually with respect to its quantity (ml) and this value is taken as the degree of swelling.

The selection of the material of the flat support is not critical. However, it is preferred for the flat support to be based on cellulose fibres, to be a synthetic paper support, the fibres of which, especially completely or partly consist of plastics material fibres, or a plastics material film. The flat support is preferably used with a weight per unit area of about 20 to 600 g/m$^2$, especially of about 30 to 300 g/m$^2$.

No particular demands are to be made of the selection of the materials of the thermal reaction layer(s) either. Colour formers, colour developers, further binders, pigments, auxiliary melting additives, ageing protection agents and further additives etc. are possible materials. The thermal reaction layer accordingly contains the important functional constituents, which are ultimately responsible for the development of a script or an image.

There is no relevant restriction in the selection of the colour former and the colour developer for the thermal reaction layer(s) of the recording material according to the invention. In this case, colour formers will preferably be present in the form of 2-anilino-3-methyl-6-diethyl-amino-fluoran, 2-anilino-3-methyl-6-di-n-butylamino-fluoran, 2-anilino-3-methyl-6-(N-ethyl-,N-p-toluidino-amino)-fluoran, 2-anilino-3-methyl-6-(N-methyl-, N-propyl-amino)-fluoran, 2-anilino-3-methyl-6-(N-ethyl-, N-isopentyl-amino)-fluoran and/or 3,3-bis-(4-dimethylamino-phenyl)-6-dimethyl-amino-phthalide and the colour developers are used in the form of phenol or urea derivatives such as 2,2-bis-(4-hydroxyphenyl)-propane, bis-(4-hydroxyphenyl)-sulfone, 4-hydroxy-4'-iso-propoxy-diphenyl-sulfone, bis-(3-allyl-4-hydroxy-phenyl)-sulfone, 2,2-bis-(4-hydroxyphenyl)-4-methyl-pentane, N-(toluenesulfonyl)-N'-(3-p-toluenesulfonyl-oxy-phenyl)-urea and zinc salts of derivatives of salicylic acid. As mentioned, various other substances or auxiliaries favoring the properties may also be contained in the thermal reaction layer(s). These may, for example, be sensitising auxiliary melting additives, slip additives, auxiliary rheology agents, fluorescent substances and the like.

The sensitising auxiliary melting additives are present, for example, in the form of 2-benzyloxy-naphthaline (BON), p-benzylbiphenyl (PBBP), oxalic acid-dibenzylester, oxalic acid-di-(p-methylbenzyl)-ester, 1,2-bis-(phenoxy-methyl)-benzene, 4-(4-tolyloxy)-biphenyl, ethylene glycol-diphenylether, ethylene-glycol-m-tolylether and 1,2-bis-(3,4-dimethylphenyl)-ethane and the slip additive is present in the form of fatty acid amides, such as, for example, stearic acid amide, fatty acid alkanolamides, such as, for example, stearic acid methylolamide, ethylene-bis-alkanoylamides, such as, for example, ethylene-bis-stearoylamide, synthetic waxes, such as, for example, paraffin waxes with various melting points, ester waxes of different molecular weights, ethylene waxes, propylene waxes of different hardnesses or else natural waxes, such as, for example, carnauba wax and/or fatty acid metal soaps, such as, for example, zinc stearate, calcium stearate or else behenate salts, the auxiliary rheology agents in the form of water-soluble hydrocolloides, such as, for example, starches, starch derivatives, sodium alginates, polyvinyl alcohols, methyl celluloses, hydroxyethyl celluloses or hydroxypropylmethyl celluloses, carboxymethyl celluloses, poly(meth)-acrylates, optical brighteners in the form of white toners, such as, for example, from the substance groups diaminostilbene-disulfonic acid, distyryl-biphenyls, benzoxazole derivatives, fluorescent substances in the form of daylight luminous pigments of different colour tones or fluorescent fibres, ageing protection agents in the form of sterically hindered phenols, such as, for example, 1,1,3-tris-(2-methyl-4-hydroxy-5-cyclohexyl-phenyl)-butane, 1,1,3-tris-(2-methyl-4-hydroxy-5-tert.-butyl-phenyl)-butane, 1,1'-bis-(2-methyl-4-hydroxy-5-tert.-butyl-phenyl)-butane and 1,1'-bis-(4-hydroxyphenyl)-cyclohexane.

The thermal reaction layer(s) are preferably used with a weight per unit area of about 1 to 8 g/m$^2$, especially of about 2 to 6 g/m$^2$.

(A) conventional intermediate layer(s) may also be used as the intermediate layer(s). The intermediate layer increases the image quality, prevents the heat conduction into the raw paper and assists the function and sensitivity properties of the thermal reaction layer. Especially, it also contributes to adequate fixing of the fusible components in the writing process and thus ensures good operability in the thermal printer.

Suitable materials for the intermediate layer(s) are those, which allow adhesion of the thermal reaction layer to the flat support, for example to protect or to insulate the thermal reaction layer. Apart from optionally the cross-linked biopolymer material in the form of nanoparticles, further binders, pigments, auxiliary rheology agents, dispersing agents, optical brighteners and surfactants are used as conventional materials. The binders are preferably present in the form of synthetic and/or natural polymers. The pigments are preferably organic hollow sphere pigments or inorganic pigments, such as, for example, calcined kaolin. Mixtures of these pigments, but also $CaCO_3$ or Ca silicates or others may also be used.

The respective intermediate layer is preferably used with a weight per unit area of about 1 to 14 g/m$^2$ and, especially, of about 2 to 9 g/m$^2$.

If desired, further layers may be used. Thus, for example, an outer layer (topcoat) may be applied, which has the function of a protective layer. A layer such as this advantageously consists of film-forming polymers, such as polyvinyl alcohols, modified polyvinyl alcohols, polyacrylates and polyurethanes, into which pigments can also be introduced, it being expedient to cross-link the film-forming polymer. The function of the protective layer is, especially, favourable when the film-forming polymer is substantially cross-linked. The cross-linking takes place in general by inclusion of cross-linking-promoting agents during the drying of the coating compound used in the forming of the protective layer. A further layer (backcoat) may also be present on the rear, which provides additional protection, for example during printing, lamination, etc.

The core of the invention is that a cross-linked biopolymer material in the form of nanoparticles is used in at least one of the layers, preferably in the thermal reaction layer(s) and/or the intermediate layer(s) and especially preferably in the intermediate layer(s).

A material of this type is, for example, known from U.S. Pat. No. 6,677,386 and WO 2008/022127. Reference is made here with respect to the entire contents of these documents with respect to the cross-linked biopolymer material in the form of nanoparticles.

The cross-linked biopolymer material in the form of nanoparticles is preferably produced by the method described in U.S. Pat. No. 6,677,386, according to which a biopolymer material, such as, for example, starch, containing amylose and amylopectin or both, is mixed with a plasticiser. This mixture is mixed under the action of strong shear forces with plasticising of the biopolymer material and formation of a thermoplastic melt phase, preferably in a co-rotating completely meshing twin-screw extruder, whereby the crystalline structure of the biopolymer material is lost. In order to cross-link the nanoparticles, a cross-linking agent is added during the mixing process. The nanoparticles leave the extruder as a strand, which is ground to form a fine powder. The nanoparticles are in an agglomerated form in the powder and can be dispersed in an aqueous medium.

The biopolymer material may be starch or other polysaccharides, such as cellulose and natural gums, and proteins (for example gelatine, whey protein). The biopolymer material may be modified beforehand, for example with cationic groups, with carboxymethyl groups, by acylation, phosphorylation, hydroxyalkylation, oxidation or the like. Starches, starch derivatives and mixtures of other polymers, which contain at least 50% starch, are preferred. The starch, either as an individual component or in a mixture with other polymers, and the starch derivatives preferably have a molecular weight of at least 10,000 g/mol and are not dextran or dextrin. Wax starches, such as, for example, waxy maize starch, are especially preferred.

The biopolymer material, at the beginning of the method, preferably has a dry weight of at least about 50% by weight. The method is preferably carried out at at least about 40° C., but below the decomposition temperature of the biopolymer material, for example at about 200° C.

The shear forces may be such that 100 J specific mechanical energy act per g biopolymer material. Depending on the apparatus used, the minimum energy may be higher; even if non-gelatinized material is used, the specific mechanical energy may be higher, for example at least about 250 J/g, preferably at least about 500 J/g.

The plasticiser may be water or a polyol (for example ethylene glycol, propylene glycol, polyglycols, glycerol, sugar alcohols, urea, citric acid ester, etc.). The total quantity of plasticiser is preferably between about 15 and 50%. A slip additive, such as lecithin, other phospholipids or monoglycerides may, if desired, be added, for example in a quantity of about 0.5 to 2.5% by weight. An acid, preferably a solid or semi-solid organic acid, such as maleic acid, citric acid, oxalic acid, lactic acid, gluconic acid or a carbohydrate-degrading enzyme, such as amylase, may be present in a quantity of about 0.01 to 5% by weight, based on the biopolymer material. The acid or the enzyme helps in the slight depolymerization, which is advantageous in the production of nanoparticles of a defined size.

The cross-linking is preferably reversible, this being partly or completely eliminated after the mechanical processing. Suitable reversible cross-linking agents preferably contain those which form chemical bonds at a low water concentration and dissociate or hydrolyse again in the presence of a higher water concentration. This type of cross-linking leads to a temporary high viscosity during the method followed by a low viscosity on conclusion of the method. Examples of reversible cross-linking agents are dialdehydes and polyaldehydes, acid anhydrides and mixed anhydrides and the like (for example succinate and acetic acid anhydride). Suitable dialdehydes and polyaldehydes are glutaraldehyde, glyoxal, periodate-oxidated carbon dioxides and the like. Glyoxal is an especially suitable cross-linking agent.

The cross-linking agents may be used alone or as a mixture of reversible and non-reversible cross-linking agents. Conventional cross-linking agents, such as epichlorohydrin and other epoxides, triphosphates, divinyl sulphone, can be used as non-reversible cross-linking agents for biopolymer material based on polysaccharides. Dialdehydes, thiol reagents and the like can be used for biopolymers based on protein. The cross-linking can take place in an acid-catalysed or alkali-catalysed manner. The quantity of cross-linking agent may be between about 0.1 and 10% by weight in relation to the biopolymer material. The cross-linking agent may already be present at the beginning of the mechanical conversion, but in the case of a non-pregelatinised biopolymer material, such as, for example, granular starch, it is preferred for the cross-linking agent to be added later, for example during the mechanical conversion.

The mechanically treated, cross-linked biopolymer material is preferably then brought into the form of a latex, in that it is dispersed in a suitable solvent, generally in water and/or another hydroxylic solvent, such as, for example, alcohol, at a concentration between about 4 and 50% by weight, especially preferably between about 10 and 40% by weight. Before the dispersion, a cryogenic grinding process can be carried out but stirring at a slightly elevated temperature may also be expedient. This processing leads to a gel, which either spontaneously or after induction by water adsorption assumes the form of a latex. This viscosity behaviour can be used for the application of the particles, such as, for example, improved mixing behaviour. If desired, the dispersed biopolymer material can be further cross-linked, with the same or different cross-linking agents. The extrudate is characterised in that it swells up in an aqueous solvent, for example in water or a mixture containing at least about 50% water together with a solvent that can be mixed in water, such as an alcohol, and after a viscosity drop forms a dispersion of nanoparticles.

It is also possible to use, as the cross-linked biopolymer material in the form of nanoparticles, conjugates thereof. This is the cross-linked biopolymer material described above in the form of nanoparticles, which are chemically or physically connected to a further additive. Possible examples of additives are titanium dioxide, aluminium oxide, aluminium trihydrate, sodium aluminium phosphate, aluminium phosphate, sodium-aluminium magnesium silicate, light ash, zeolites, sodium-aluminium silicate, sebum clay minerals, delaminated alumina, calcined kaolin alumina, montmorylonite alumina, nano alumina, silica particles, zinc oxide, calcium carbonate, optical brighteners, biocides, stabilisers etc. and combinations thereof. Conjugates of this type are described, for example, in WO 2010/065750 A1.

As mentioned, the cross-linked biopolymer material in the form of nanoparticles is preferably used in the thermal reaction layer(s) and/or the intermediate layer(s). Especially preferred is the use thereof in the intermediate layer(s), as owing to the remaining coat porosity, an increase in the insulation could be achieved and therefore the thermal reaction sensitivity could be improved. In addition to this, the absorption of fusible components is favoured in the writing process, which, especially in the case of heat-sensitive recording materials without a topcoat, is advantageous with respect to the depositing behaviour on the thermal strip.

In a preferred embodiment, the cross-linked biopolymer material in the form of nanoparticles is starch, a starch derivative or a polymer mixture with at least about 50% by weight starch or starch derivative, starch and starch derivatives being especially preferred. Quite especially preferred is starch, especially a cross-linked starch, which has not been otherwise modified.

The average mean particle size of the nanoparticles is preferably between about 10 nm and 600 nm, especially preferably between about 40 nm and 400 nm and quite especially preferably between about 40 nm and 200 nm. Ecosphere 2240 biolatex binder, Ecosphere 92240, 92273, X282 biolatex binder and Ecosphere 2202 (all obtainable from EcoSynthetix Inc.) may be used, for example, as the cross-linked biopolymer material.

The biopolymer material in the form of nanoparticles is present in the respective layer(s) preferably in a quantity of about 1 to 50% by weight, especially preferably in a quantity of about 2 to 40% by weight, and especially preferably in a quantity of about 2 to 30% by weight, based on the total weight of the dry mass of the respective layer. Quantities that are too low have the drawback that the attachment of the adjacent layers is unsatisfactory.

In an especially preferred embodiment, the flat support has a weight per surface area of about 20 to 600 $g/m^2$, especially of about 30 to 300 $g/m^2$, the respective intermediate layer(s) have a weight per surface area of about 1 to 14 $g/m^2$, especially of about 2 to 9 $g/m^2$ and/or the thermal reaction layer(s) have a weight per unit area of about 1 to 8 $g/m^2$, especially of about 2 to 6 $g/m^2$.

In a further preferred embodiment, at least one further binder is also present in the layer(s), in which the cross-linked biopolymer material in the form of nanoparticles is located. This has the advantage that owing to the combination of various binders and their characteristics, the desired result can be further adapted to the demands on the respective heat-sensitive recording material, especially in relation to the visual appearance, insulation behaviour and/or further specific features. The at least one further binder is preferably present in a quantity of less than 20% by weight in the respective layer.

When selecting the at least one further binder, the invention is substantially free, as long as the properties of the heat-sensitive recording material are not thereby impaired. At least one further binder is preferably in the form of water-soluble starches, starch derivatives, hydroxyethyl celluloses, polyvinyl alcohols, modified polyvinyl alcohols, acrylamide/(meth)acrylate copolymers and/or acrylamide/acrylate/methacrylate terpolymers. Materials of this type lead to a coating that is water-soluble. On the other hand, there are also those that lead to a water-insoluble structure. These are, for example, lattices, such as polymethacrylate esters, styrene/acrylate ester copolymers, styrene/butadiene copolymers, polyurethanes, acrylate/butadiene copolymers, polyvinyl acetates and/or acrylonitrile/butadiene copolymers and the like. The person skilled in the art may consider using an especially suitable binder or binder mixture here in the individual case. The use of polyvinyl alcohol is especially preferred.

The at least one further binder may be present in all the layers, preferably in the thermal reaction layer(s) and/or the intermediate layer(s), the use thereof in the intermediate layer(s) being especially preferred as the desired properties can be especially improved by this.

A further binder is taken to mean here a binder, which is used in addition to the cross-linked biopolymer material in the form of nanoparticles in the layer(s), in which the cross-linked biopolymer material in the form of nanoparticles is present. It is obvious that one or more conventional binders may be present in those layers in which the cross-linked biopolymer material in the form of nanoparticles is not used.

In other words, one or more conventional binders can be completely or partly replaced by a cross-linked biopolymer material in the form of nanoparticles in the heat-sensitive recording material according to the invention. This applies to all the layers.

In a preferred embodiment, the heat-sensitive recording material according to the invention is a heat-sensitive recording material with a flat support, a thermal reaction layer on at least one side of the flat support and an intermediate layer formed between the flat support and the respective thermal reaction layer, and optionally further layers, a biopolymer material in the form of nanoparticles being used as the binder in at least one of the layers.

In a preferred embodiment, the heat-sensitive recording material comprises a flat support, a thermal reaction layer and an intermediate layer formed between the flat support and the thermal reaction layer, wherein present in the intermediate layer, in addition to the cross-linked biopolymer material in the form of nanoparticles, are inter alia, at least one pigment, preferably at least one hollow sphere pigment, and at least one co-binder, preferably polyvinyl alcohol, latex or starch (this is a different starch to the starch that can be used as cross-linked biopolymer material in the form of nanoparticles, for example natural enzymatically or oxidatively degraded starches, starch esters or starch ethers), especially preferably polyvinyl alcohol. Instead of a hollow sphere pigment, an inorganic pigment or a mix of the two can also be used. Especially suitable hollow sphere pigments are styrene/acrylate copolymers. The cross-linked biopolymer material in the form of nanoparticles is preferably present here in a quantity of about 1 to 40% by weight, especially preferably in a quantity of 2 to 30% by weight, the pigment (mixture) is preferably present in a quantity of about 50 to 95% by weight, especially preferably in a quantity of about 60 to 90% by weight, and the co-binder is preferably present in a quantity of about 0 to 10% by weight, especially preferably about 1 to 9% by weight.

In a preferred embodiment, the cross-linked biopolymer material in the form of nanoparticles is obtainable by means of a method in which a biopolymer material is plasticised by using shear forces and in the presence of a cross-linking agent and optionally then dispersed in a hydroxylic solvent, preferably water.

Diverse methods are available to the person skilled in the art to produce, according to the invention, the heat-sensitive recording material of the invention. Thus, for example, the two sides of the support substrate may be simultaneously provided on-line in the paper machine with the coating compound to form the intermediate layers. It is also possible to firstly provide the one side and then the other side of the support substrate with intermediate layers. The respective application method is therefore not subject to any restrictions and can be carried out in the conventional manner. The same also applies to the configuration of the thermal reaction layer, in which an aqueous dispersion, which contains the necessary and promoting constituents, is conventionally applied and dried. The person skilled in the art accordingly does not need any further technical instructions.

The present invention also relates to a method for producing the heat-sensitive recording material described above, in which a cross-linked biopolymer material in the form of nanoparticles is used, preferably as a powder, especially preferably directly in the colour formulation.

This has the advantage that, compared to conventional cooking starches, greater quantities of biopolymer material can be used and that higher coating colour solid contents can be provided without the rheological properties being impaired thereby.

The heat-sensitive recording material according to the invention can be used in many areas, for example as paper for fax printing, the printing of sales slips or receipts, car park tickets, entry and travel tickets, medical investigation programs and barcode labels.

The recognitions or advantages connected with the present invention can be substantially summarized as follows:

Binders or presumably especially their low-molecular accompanying substances from all the layers, can impair the ageing resistance. These negative effects increase with an increasing storage period of the paper at elevated temperatures and increased ambient humidity, as is, for example, the case in the Tropics. Migration processes, especially of the low-molecular accompanying substances probably play a part here. The use of synthetic lattices has a negative influence, especially, on the writing performance and the script stability.

The present invention, especially the use of a cross-linked biopolymer material in the form of nanoparticles, leads to a heat-sensitive recording material, the ageing resistance of which is significantly improved. The ageing resistance relates both to the ageing before inscription, i.e. the ageing of the non-printed thermal paper, and to the ageing after inscription, in other words the ageing of the thermal print. Likewise, the background white of the heat-sensitive recording material according to the invention is also very favourable after ageing.

Clear positive effects are also shown by the heat-sensitive recording material according to the invention with regard to the so-called depositing behaviour on the thermal strip. This is an important property feature of thermal papers, which represents the degree of soiling of a thermal strip in the application. Upon heating of a thermal paper in the thermal printer, a melting process occurs, the melt forming being able to lead to deposits on the thermal strip of the printer. It is of decisive importance here whether the thermal melt is fixed to an adequate extent in the thermal functional layers. A central role is adopted here by the absorption capacity of the intermediate layer, a porous coat structure being very helpful. The use of a cross-linked biopolymer material in the form of nanoparticles in the intermediate layer leads to a coat porosity of this type, so a reduced tendency to soiling of the thermal print head can be achieved, especially when using a rather non-absorptive hollow sphere pigment as the pigment in the intermediate layer.

Finally, the heat-sensitive recording material according to the invention can be produced more economically and the use of synthetic binders, which have to be obtained from fossil raw materials, can be reduced.

The invention will be described in detail below with the aid of non-limited examples.

EXAMPLES

Production of Heat-Sensitive Recording Materials

An intermediate layer formulation according to Table 1 (Formulation 1) or an intermediate layer formulation according to Table 2 (Formulation 2), was applied using a dry application of about 3 g/m$^2$ by means of a doctor blade to a conventional flat support (thermal crude paper) with a respective weight per surface area of 44 g/m$^2$.

The paper substrates thus produced were then coated with a thermal coating compound according to Table 3 (Formulation 3). The coat application was about 4.5 g/m$^2$ (otro) by means of a doctor blade. The coating dispersion A mentioned there was produced by grinding 30 parts by weight 2-anilino-3-methyl-6-di-n-butylamino-fluoran with 55 parts by weight of a 15% aqueous polyvinyl alcohol solution in a ball mill to form an average particle size of 1.5 μm. The coating dispersion B was produced by grinding 65 parts by weight 2,2-bis-(4-hydroxyphenyl)-propane together with 35 parts by weight benzyl-naphthyl-ether, 75 parts by weight of a 15% aqueous polyvinyl alcohol solution and 90 parts by weight water in a mill to an average particle size of 1.5 μm.

TABLE 1

| Formulation 1 Component | DW % | Wet mass 100% g | Furnace dry (otro) g |
|---|---|---|---|
| Water | | 5.50 | — |
| Ropaque HP-1055*1 | 27 | 71.08 | 19.19 |
| Styron Latex*2 | 48 | 14.66 | 7.04 |
| PV-OH*3 | 20 | 8.58 | 1.72 |
| Auxiliary rheology agent*4 | 31 | 0.18 | 0.06 |
| | | 100.00 | 28.00 |

pH = 8.2; Brookfield viscosity (100 rpm; spindle 3; 20° C.) = 380 mPas
*1hollow sphere pigment company Dow (styrene/acrylate copolymer)
*2binder of the type styrene/butadiene latex (company Styron)
*3polyvinyl alcohol low-viscous, highly saponified (company Kuraray)
*4Rheocoat type from the company Coatex (acrylate copolymer)

TABLE 2

| Formulation 2 Component | DW % | Wet mass 100% g | Furnace dry (otro) g |
|---|---|---|---|
| Water | | 13.73 | — |
| Ropaque HP-1055*1 | 27 | 70.43 | 19.02 |

TABLE 2-continued

| Formulation 2 Component | DW % | Wet mass 100% g | Furnace dry (otro) g |
|---|---|---|---|
| Ecosphere 2240*2 | 95 | 7.35 | 6.98 |
| PV-OH*3 | 20 | 8.49 | 1.70 |
| | | 100.00 | 27.70 |

pH = 8.8; Brookfield viscosity (100 rpm; spindle 4; 20° C.) = 1400 mPas
*1hollow sphere pigment company Dow (styrene/acrylate copolymer)
*2cross-linked starch, EcoSphere ® quality (company Ecosynthetix)
*3polyvinyl alcohol low-viscous, highly saponified (company Kuraray)

TABLE 3

| Formulation 3 Component | Wet mass 100% g | Furnace dry (otro) g |
|---|---|---|
| Water | 12.35 | — |
| PVA highly viscous, highly saponified (10%) | 10.44 | 1.04 |
| Leukophor UO (31.3%)*1 | 0.22 | 0.07 |
| PCC slurry (55%)*2 | 28.92 | 15.91 |
| Dispersion B | 25.52 | 10.72 |
| Stearic acid amide dispersion*3 | 11.12 | 2.78 |
| Zn stearate dispersion*3 | 4.84 | 1.45 |
| Dispersion A | 5.92 | 2.66 |
| Auxiliary rheology agent (25%)*4 | 0.67 | 0.16 |
| | 100.00 | 34.8 |

pH = 8.3; Brookfield viscosity (100 rpm; spindle 3; 20° C.) = 480 mPas;
Surface tension (static ring method according to Du Nouy) 48 mN/m; dry content about 35% by weight
*1optical brightener (anionic stilbene derivative) (company Clariant)
*2$d_{50}$: 1.0μ, calcite type,
*3company Chukyo
*4Sterocoll type (company BASF) (copolymer of acrylic acid esters and carboxylic acids)

Aging after Inscription

The heat-sensitive recording materials thus obtained were subjected to an aging test (aging after inscription), in two defined climates over a time period of several weeks. The image stability was determined weekly.

For this purpose, a typeface was generated on the thermal printer and its optical density was determined before aging. Thereafter, the material was aged suspended freely in different climates over a specific time period. The climates were dry heat (50° C.) and moist heat (40° C./80% ambient humidity) in each case over a time period of 1, 2, 4, 6 and 9 weeks. After aging, the remaining optical density was measured and the drop in the image stability determined in %: $(OD^{after}/OD^{before}-1)*100$. Furthermore, the background white of the respective paper samples was determined after aging. The white measurement took place from the upper side using an Elrepho 3000 reflection photometer (company Datacolor). The degree of whiteness was determined here using filter R 457 (ISO 2470) without a UV-filter.

The results are summarized in Table 4.

TABLE 4

| Image stability after aging | | % drop in the optical density after x weeks aging | | | | Background white % after x weeks aging | |
|---|---|---|---|---|---|---|---|
| | | 0.25 mJ/dot | | 0.45 mJ/dot | | | |
| Intermediate layer after: | Test duration | 50° C. | 40° C./80% a.h. | 50° C. | 40° C./80% a.h. | 50° C. | 40° C./80% a.h. |
| Formulation 1 | 1 week | −24.1 | −25.5 | −1.6 | −3.9 | 77.2 | 81.3 |
| | 2 weeks | −28.4 | −36.4 | −6.6 | −6.3 | 74.3 | 76.4 |
| | 4 weeks | −40.5 | −42.7 | −18.0 | −11.8 | 72.2 | 72.2 |
| | 6 weeks | −46.6 | −50.9 | −27.0 | −18.1 | 68.5 | 70.3 |
| | 9 weeks | −49.1 | −56.4 | −31.1 | −19.7 | 67.3 | 69.5 |

TABLE 4-continued

| Image stability after aging | | % drop in the optical density after x weeks aging | | | | Background white % after x weeks aging | |
|---|---|---|---|---|---|---|---|
| | | 0.25 mJ/dot | | 0.45 mJ/dot | | | |
| Intermediate layer after: | Test duration | 50° C. | 40° C./80% a.h. | 50° C. | 40° C./80% a.h. | 50° C. | 40° C./80% a.h. |
| Formulation 2 | 1 week | −17.6 | −21.8 | 1.7 | 2.5 | 78.0 | 82.6 |
| | 2 weeks | −21.6 | −22.8 | −0.8 | −0.8 | 76.5 | 82.7 |
| | 4 weeks | −28.4 | −28.7 | −6.8 | −0.8 | 75.3 | 81.7 |
| | 6 weeks | −30.4 | −39.6 | −12.7 | −5.8 | 71.6 | 80.4 |
| | 9 weeks | −35.3 | −38.6 | −14.4 | −6.6 | 72.3 | 80.9 |

The results show a more stable aging behaviour of the heat-sensitive recording material when using formulation 2 in comparison to a heat-sensitive recording material when using formulation 1.

The increased stability of the background can be seen especially in the case of a relatively long storage period. This trend is shown in an especially reinforced manner under moist warm climatic conditions.

Depositing Behaviour:

The test of the depositing behaviour took place on two conventional commercial thermal printers (Epson TM-T8811 and Mettler-Waage Type L2-RT) and was evaluated after visual assessment with grades of 0 to 3:

Table 5 shows the evaluation of the depositing on the thermal strip:

TABLE 5

| Note | Printer A | Printer B |
|---|---|---|
| Formulation 1 | 2-3 | 2-3 |
| Formulation 2 | 0.5-1 | 0.5-1 |

0 = no deposits,
1 = slight/visible,
2 = average,
3 = strong

The heat-sensitive recording material with formulation 2 exhibited significantly better depositing behaviour than the heat-sensitive recording material using formulation 1.

Aging Before Inscription:

To determine the storage stability, i.e. the stability of a heat-sensitive recording material before inscription, a conventional thermal paper with its thermal reaction layer (reference paper) was brought into contact with a pure binder layer, which was applied to a raw paper (counter-paper). The reference paper is a standard POS paper (obtainable from the paper factory August Koehler SE). The binder to be investigated was provided as a solution or as a dispersion. The binder solution or dispersion was applied to a thermal raw paper by means of a doctor blade. The application weight was in the range from 2 to 3 g/m$^2$ (dry). The paper was then stored at 35° C./75% ambient humidity between Plexiglas plates at a defined pressure of 7 kg. After defined time intervals of 4, 8, 12, 16, 20, 28 weeks, a sample was removed and printed on a thermal printer to determine the remaining writing performance. For this purpose, the optical density was measured before or after the aging of the paper and the writing performance [$(OD^{after}/OD^{before})*100$] was determined. This test method is directed at the influence of the binder on the aging of the heat-sensitive recording material. The results can be inferred from Table 6. It can be seen that the heat-sensitive recording material has a significantly improved storage stability using a cross-linked biopolymer material in the form of nanoparticles (No. 2) compared to heat-sensitive recording materials with known binders.

TABLE 6

| Aging before writing | | Writing performance [%] 0.25 mJ/dot; 35° C./75% a.h. | | | | | | Writing performance [%] 0.45 mJ/dot; 35° C./75% a.h | | | | | |
|---|---|---|---|---|---|---|---|---|---|---|---|---|---|
| No. | Binder | 4 wks | 8 wks | 12 wks | 16 wks | 20 wks | 28 wks | 4 wks | 8 wks | 12 wks | 16 wks | 20 wks | 28 wks |
| 1 | Reference without contact with the counter-paper | 97.0 | 92.9 | 99.0 | 93.9 | 92.9 | 93.9 | 97.7 | 97.7 | 100.8 | 95.5 | 99.2 | 98.5 |
| 2 | Reference paper in contact with Ecosphere 2240 | 97.0 | 91.9 | 99.0 | 89.9 | 90.9 | 93.9 | 99.2 | 94.7 | 99.2 | 94.0 | 92.5 | 92.5 |
| 3 | Reference paper in contact with SB-Latex 1 | 89.8 | 80.8 | 80.8 | 76.8 | 70.7 | 62.6 | 91.7 | 88.0 | 80.5 | 79.7 | 77.4 | 56.4 |
| 4 | Reference paper in contact with SA-Latex 1 | 81.8 | 66.7 | 72.7 | 50.5 | 39.4 | 40.4 | 88.0 | 68.4 | 75.2 | 49.6 | 42.1 | 37.6 |
| 5 | Reference paper in contact with SB-Latex 2 | 87.6 | 84.3 | 75.2 | 66.9 | 70.3 | — | 95.0 | 90.7 | 84.9 | 77.0 | 69.8 | — |
| 6 | Reference paper in contact with SB-Latex 3 | 90.9 | 79.3 | 76.9 | 71.9 | 57.9 | — | 97.1 | 89.2 | 80.6 | 79.9 | 61.9 | — |
| 7 | Reference paper in contact with SB-Latex 4 | 86.0 | 81.0 | 81.0 | 70.3 | 73.6 | — | 95.0 | 90.7 | 87.8 | 77.7 | 79.9 | — |

TABLE 6-continued

| Aging before writing | | Writing performance [%] 0.25 mJ/dot; 35° C./75% a.h. | | | | | | Writing performance [%] 0.45 mJ/dot; 35° C./75% a.h | | | | | |
|---|---|---|---|---|---|---|---|---|---|---|---|---|---|
| No. | Binder | 4 wks | 8 wks | 12 wks | 16 wks | 20 wks | 28 wks | 4 wks | 8 wks | 12 wks | 16 wks | 20 wks | 28 wks |
| 8 | Reference paper in contact with SA-Latex 2 | 67.8 | 44.6 | 28.1 | 29.8 | 21.5 | — | 66.9 | 38.9 | 34.5 | 25.2 | 23.7 | — |
| 9 | Reference paper in contact with PV-OH | 92.9 | 86.9 | 88.9 | 79.8 | 77.8 | 74.7 | 97.7 | 87.2 | 91.9 | 85.0 | 75.2 | 77.4 |

SB-Latex 1 = XZ34946.01 styrene-butadiene copolymer (company Styron)
SB-Latex 2 = Synthomer 76M10 (company Synthomer)
SB-Latex 3 = Litex PX9366 (company Polymer Latex)
SB-Latex 4 = XZ9182.00 (company Styron)
SA-Latex 1 = Makrovil SE348 (company Indulor)
SA-Latex 2 = DAL 7294 (company Styron)
PV-OH = polyvinyl alcohol low-viscous, highly saponified (company Kuraray)
Ecosphere 2240 = cross-linked starch, EcoSphere ® quality (company Ecosynthetix)

The invention claimed is:

1. A heat-sensitive recording material with a flat support, at least one thermal reaction layer on at least one side of the flat support and optionally an intermediate layer, which is formed between the flat support and the respective thermal reaction layer, and selectively a topcoat protection layer and a backcoat protection layer, wherein a cross-linked biopolymer material in the form of nanoparticles is used as the binder in at least one of the layers and wherein the cross-linked biopolymer material in the form of nanoparticles is obtainable by means of a method, in which a biopolymer material is plasticized using shear forces and in the presence of a cross-linking agent and then dispersed in a hydroxylic solvent, wherein the cross-linked biopolymer material in the form of nanoparticles has a degree of swelling of less than 2, wherein the degree of swelling relates to a volume expansion when the cross-linked biopolymer material in the form of nanoparticles swells in water when a sample of a water-free quantity of 2 g is added to 200 ml pure water, dispersed therein and directly thereafter this is heated in a water bath that is boiling well for 30 minutes and cooled to room temperature, the part of the water that was evaporated is added and the sample is dispersed again and 100 ml of the dispersion are placed precisely in a measuring cylinder, the measuring cylinder is allowed to stand for 24 hours at room temperature and a precipitate is measured visually with respect to its quantity (ml).

2. A recording material according to claim 1, characterised in that the cross-linked biopolymer material in the form of nanoparticles has a degree of swelling of less than 1.

3. A recording material according to claim 1, characterised in that the cross-linked biopolymer material in the form of nanoparticles is used in the thermal reaction layer(s) and/or the intermediate layer(s).

4. A recording material according to claim 1, characterised in that the cross-linked biopolymer material in the form of nanoparticles is used in the intermediate layer(s).

5. A recording material according to claim 1, characterised in that the cross-linked biopolymer material in the form of nanoparticles is a starch, a starch derivative or a polymer mixture with at least about 50% by weight starch or starch derivative.

6. A recording material according to claim 1, characterised in that the cross-linked biopolymer material in the form of nanoparticles is starch.

7. A recording material according to claim 1, characterised in that the average mean particle size of the nanoparticles is between about 10 nm and 600 nm.

8. A recording material according to claim 1, characterised in that the cross-linked biopolymer material in the form of nanoparticles is present in the respective layer(s) in a quantity of about 1 to 50% by weight, based on the total weight of the respective layer.

9. A recording material according to claim 1, characterised in that the flat support has a weight per unit area of about 20 to 600 g/m$^2$, the respective intermediate layer(s) has/have a weight per unit area of about 1 to 14 g/m$^2$, and/or the thermal reaction layer(s) has/have a weight per unit area of about 1 to 8 g/m$^2$.

10. A recording material according to claim 1, characterised in that at least one further binder is additionally present in the layer(s), in which the cross-linked biopolymer material in the form of nanoparticles is present.

11. A recording material according to claim 1, characterised in that it comprises a flat support, a thermal reaction layer and an intermediate layer formed between the flat support and the thermal reaction layer, wherein the intermediate layer contains, as the cross-linked biopolymer material in the form of nanoparticles comprising a starch or a starch derivative as the cross-linked biopolymer material in the form of nanoparticles, a hollow sphere pigment or an inorganic pigment or a mix of the two and a co-binder.

12. A recording material according to claim 11, characterized in that the co-binder is polyvinyl alcohol, latex, or a starch which differs from the starch that can be used as a cross-linked biopolymer material in the form of nanoparticles.

13. A method for producing a heat-sensitive recording material according to claim 1, characterised in that a cross-linked biopolymer material in the form of nanoparticles is used.

14. A recording material according to claim 13, characterized in that the cross-linked biopolymer material in the form of nanoparticles is used as a powder.

15. A paper for fax printing, the printing of sales slips or receipts, car park tickets, entry and travel tickets, medical investigation programs and barcode labels comprised of the heat-sensitive recording material of claim 1.

16. A recording material according to claim 1, characterized in that the average mean particle size of the nanoparticles is between about 40 nm and 400 nm.

17. A recording material according to claim 1, characterized in that the average mean particle size of the nanoparticles is between about 40 and 200 nm.

18. A recording material according to claim 1, characterized in that the cross-linked biopolymer material in the form of nanoparticles is present in the respective layer(s) in a quantity of about 1 to 40% by weight, based on the total weight of the respective layer.

19. A recording material according to claim 1, characterized in that the cross-linked biopolymer material in the form of nanoparticles is present in the respective layer(s) in a quantity of about 2 to 30% by weight, based on the total weight of the respective layer.

20. A recording material according to claim 1, characterized in that the flat support has a weight per unit area of about 30 to 300 $g/m^2$, the respective intermediate layer(s) has/have a weight per unit area of about 2 to 9 $g/m^2$ and/or the thermal reaction layer(s) has/have a weight per unit area of about 2 to 6 $g/m^2$.

* * * * *